United States Patent [19]

Peters

[11] Patent Number: 4,734,986

[45] Date of Patent: Apr. 5, 1988

[54] CAN-OPENERS

[76] Inventor: Anthony John V. Peters, 4 Quarrenden, Weirfields Road, Totnes, South Devon, England

[21] Appl. No.: 776,168

[22] PCT Filed: Jan. 16, 1985

[86] PCT No.: PCT/GB85/00018

§ 371 Date: Sep. 12, 1985

§ 102(e) Date: Sep. 12, 1985

[87] PCT Pub. No.: WO85/03280

PCT Pub. Date: Aug. 1, 1985

[30] Foreign Application Priority Data

Jan. 20, 1984 [GB] United Kingdom ..... 8401495

[51] Int. Cl.[4] ..... B67B 7/34

[52] U.S. Cl. ..... 30/410; 30/426

[58] Field of Search ..... 30/410, 415, 417, 418, 30/422, 424–427

[56] References Cited

U.S. PATENT DOCUMENTS

| | | | |
|---|---|---|---|
| 2,628,422 | 2/1953 | Yeomans . | |
| 2,924,878 | 2/1960 | Brown | 30/410 |
| 3,094,776 | 6/1963 | Smith | 30/422 |
| 4,251,916 | 2/1981 | Peres | 30/403 |

FOREIGN PATENT DOCUMENTS

| | | |
|---|---|---|
| 1288286 | 2/1962 | France . |
| 2118134 | 7/1983 | United Kingdom . |

*Primary Examiner*—Douglas D. Watts

*Attorney, Agent, or Firm*—Bacon & Thomas

[57] ABSTRACT

A tool which operates to remove the end wall (17) of a can by cutting through an outer part of the rim (11) of the can comprises a manually rotatable drive wheel (8) and a cutter wheel (12) arranged tightly to grip a cam rim therebetween. The cutter wheel is rotatably mounted in a partially cylindrical recess (R) formed within a moulded plastics housing (10) which is arranged to locate the cutter wheel (12) and provide support therefor.

15 Claims, 6 Drawing Sheets

FIG. 7.
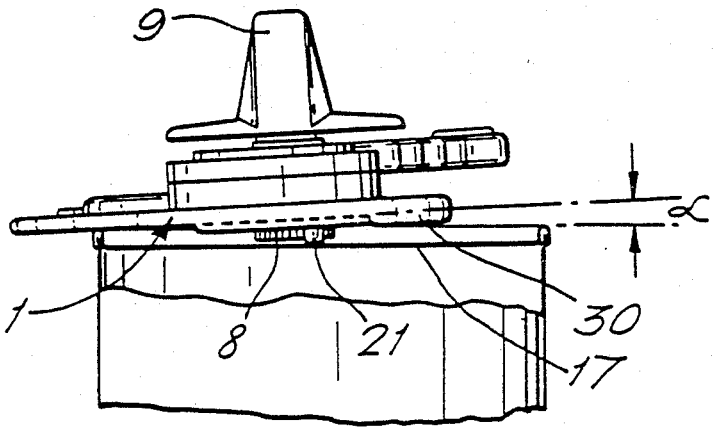
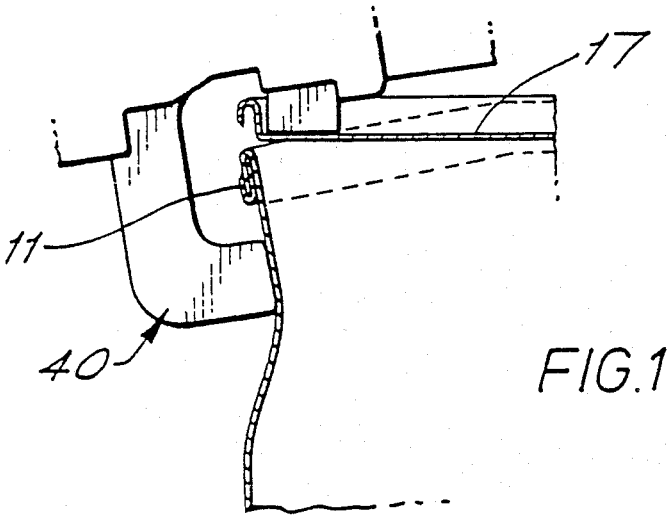
FIG. 11.

CAN-OPENERS

This invention relates to can-openers.

A disadvantage with traditional can-openers is that they are effective to cut a part of the can, usually the perimetric region of one of its end walls, which is in direct contact with the contents. Thus, a cutting portion of the opener often contacts the contents during opening and this can be unhygienic. Furthermore, slivers of metal may be detached by the cutting operation and may thus enter the can. Also the edges of the cut end wall, and in some cases the can side wall, may be left sharp and/or jagged after cutting.

Can-openers have therefore been proposed which are effective to remove an end wall of a can by cutting through part of the joint between the end wall and the can body; the joint is normally in the form of a multi-layered upstanding rim extending around the perimeter of the can end wall, and such can-openers are generally operable to separate the end wall from the can body by cutting through the outermost layer on the outside of the rim. With such openers the aforementioned problems associated with traditional openers do not arise since a cutting portion of the opener does not penetrate the can, but only an outer wall portion of the rim. A further advantage with openers of this type is that generally no potentially dangerous sharp edges remain adjacent the rim after the end wall has been removed.

However, experience shows that can-openers which cut an outer layer of the end joint or rim present significant design problems, and in practical terms it is difficult to provide reliable and consistent operation with an opener which is at the same time reasonably convenient to manufacture and thus relatively inexpensive.

Can-openers of this type generally include a rotatable cutler wheel and a rotatable drive wheel arranged tightly to engage a can rim therebetween so that the cutter wheel penetrates the outer wall of the rim, the drive wheel being rotated in operation whereby the rim is fed between the wheels and a cut is formed in the rim outer wall. With such openers, for successful operation the gripping pressure exerted by the cutter and drive wheels must be relatively high, and this can present practical difficulties concerning the mounting of the cutter wheel which must be able to withstand the force of engagement. Typically, the cutter wheel has been rotatably mounted to such openers by means of a shaft or rivet and although this approach may provide a sufficiently firm mounting in the case of an all metal opener, problems may be encountered where it is desired to form the main parts of an opener from a plastics material which may not be strong enough to anchor a shaft or rivet sufficiently firmly. A further problem regarding the mounting of the cutter wheel in certain types of opener which operate by cutting around the rim is that for reliable operation the arrangement should be such that close tolerances can be maintained in the position of the cutter wheel relative to other parts of the opener, and cutter mounting arrangements which present practical difficulties in providing a precise relative location of the cutter wheel are undesirable.

Viewed from a first aspect the invention provides a can-opener which operates to separate an end wall of a can by cutting through an outer part of a rim joining such end wall with the main body of the can, the can-opener comprising a plastics body portion mounting a cutter wheel arranged for engagement with said outer part of the rim, and a rotatable drive wheel arranged to engage an inner part of the rim in gripping relation with the cutter wheel, wherein the cutter wheel is rotatably mounted in a recess formed in a part of said body portion which is arranged to locate said cutter wheel and to provide support therefor.

In accordance with the invention the mounting of the cutter wheel in a recessed part of the plastics body portion is such that the disadvantages associated with known arrangements may be overcome. Thus, a sufficiently firm mounting may be provided to withstand the force on the cutter wheel consequent upon tight gripping engagement with a can rim, whilst at the same time precise location of the cutter wheel may be obtained by fabrication of the locating recess, e.g. by moulding, to within suitably close tolerances which are relatively straight-forward to achieve in practical terms.

In a preferred embodiment the cutter wheel includes an annular cutting edge located between a pair of axially spaced annular flanges having cylindrical outer surfaces which bear directly on a peripheral wall defining said recess which in this embodiment is partially cylindrical. In such an arrangement, the cutter wheel may conveniently be loosely fitted in the recess for rotation therein by lateral insertion into the recess during assembly of the opener, removal of the cutter wheel from the fully assembled opener being prevented by cooperation of a further part of the opener therewith.

In a preferred embodiment the axis of rotation of the drive wheel is substantially parallel in use with the longitudinal axis of the can, the drive wheel being eccentrically mounted to a rotatable disc carried by the body portion whereby a can rim may be tightly gripped between the cutter and the drive wheel by rotation of the disc relative to said body portion. Thus, in this embodiment in use a can rim is introduced between the cutter and the drive wheel in a spaced apart condition thereof, and the disc is then rotated such that the rim becomes tightly gripped between the cutter and drive wheel such that the cutter penetrates an outer part of the rim. The drive wheel may then be rotated such that the rim of the can is fed between the cutter and drive wheel. The gripping arrangement in accordance with this embodiment of the invention involving a drive wheel eccentrically mounted to a disc provides reliable opening and is relatively simple mechanically.

It is envisaged that an opener in accordance with the invention may be in the form of a wall-mounted unit and that if desired a suitable powered drive means for the drive wheel may be provided. In a presently preferred embodiment, however, the opener is in the form of a hand-held unit, and the body portion of the opener and the part carrying the drive wheel are secured to or integral with respective hand grips. The hand grips are preferably movable relative to one another in a scissor-type manner, closing of the hand grips into a generally coextensive condition causing movement of the drive wheel into gripping engagement with a can rim in use.

The cutter wheel is preferably freely rotatable about an axis which is also substantially parallel in use with the longitudinal axis of the can. In a preferred embodiment, the spaced and parallel axes of rotation of the rotatable disc carrying the drive wheel, the drive wheel and the cutter wheel respectively are non-aligned in the operational condition of the opener, so that as the drive wheel rotates against the resistance of the cutter wheel there is a torque on the disc mounting the drive wheel which tends to maintain the pressure exerted on the rim.

In addition, mis-alignment of the three axes allows for compensation for wear to either the cutter or drive wheel. Thus, should for example the drive wheel become worn, the reduced radius will be compensated for by the disc rotating slightly further before gripping of a rim between the cutter and the drive wheel occurs. Suitable stops may be provided on the rotatable disc and/or the body portion to prevent over rotation of the disc and penetration of the cutter into or through the can body itself.

The feature of non-alignment of the axes in the operational condition is of significance in its own right and accordingly viewed from a second aspect the invention provides a can-opener which operates to separate an end wall of a can by forming a cut in or below the can rim, such opener comprising a cutter wheel carried by a body portion of the opener and rotatable about a first axis which in use is substantially parallel to the longitudinal axis of the can, and a drive wheel arranged for rotation about a second axis parallel to the first, the drive wheel being carried by a member which is rotable relative to the body portion about a third axis, the third axis being parallel to and offset from the second whereby the cutter and drive wheels may be brought into gripping engagement with a can rim by relative rotation of said member and body portion, wherein said first, second and third axes are nonaligned in the operational condition of the opener, the arrangement thereby being such that rotation of the drive wheel creates a torque on said member which tends to maintain the gripping pressure exerted on the rim.

With can-openers of this general type problems can arise in guiding the line of cut around the rim sufficiently accurately such that the cutter meets up with its starting point once it has traversed the entire periphery of the can, and does not slip off the rim, whereby a complete cut around the rim is achieved. To this end, it has previously been proposed to provide a portion of the can-opener which abuts the upper surface of the can rim in use so as to guide the cutter around the rim in an attempt to ensure that the spacing between the top of the rim and the cut remains constant. For the same purpose, it has also been proposed to provide a drive wheel which in addition to engaging the inner side of the rim also bears down on its top surface. However, with such arrangements precise manufacturing tolerances are necessary in the construction of the opener as a whole in order to ensure that the cutter is accurately spaced from the portion which is adapted to engage the top part of the rim, and moreover variations may subsequently occur due to slackness or wear in any of the moving parts.

Thus, in a preferred embodiment the cutter wheel includes a shoulder portion integral or fast with the cutting edge which is adapted to engage the top of the rim in use so as to locate accurately the height of the cutting edge relative to the rim. In this way the part which engages the top of the rim is integral or fast with the cutting edge and variations in the height of the cutter wheel in use resulting from slackness or wear of other parts of the opener may therefore be avoided such that reliable operation is achieved. Furthermore, the only precise manufacturing tolerance required to set the position of the cutter is in the manufacture of the cutter wheel itself. This is a relatively simple matter, since the cutting edge together with the shoulder portion may conveniently be machined from a single piece of metal. In the embodiment discussed above wherein the cutting edge is located between spaced flanges of the cutter wheel, one of said flanges may conveniently define said shoulder portion for engagement with the top of the can rim.

In a preferred embodiment, the axis of rotation of the cutter wheel is substantially parallel to the longitudinal axis of the can, but is off-set by a small angle, preferably between and ½° and 3°, in the direction of relative movement between the rim and the cutter. In this way, the angle of attack of the cutter into the rim, the so-called dive angle, has the effect of causing the shoulder portion to bear constantly against the top of the can rim, thus ensuring that the cut always runs parallel to the edge of the rim. The slight angling of the cutter may conveniently be achieved by a suitable member provided on a body portion of the opener which engages in use the end wall of the can.

In a preferred embodiment, the cutter wheel further comprises a second shoulder portion fast or integral with the cutting edge and adapted for engagement under the rim of the can. Such a shoulder portion ensures that the rim is not released from the opener during cutting. Again, such shoulder portion may be defined by a flange of said cutter wheel of the type discussed above. The lower flange may additionally be adapted to engage the wall of the main body of the can itself, beneath the rim, thereby providing additional guidance of the opener relative to the can.

With known can-openers adapted to remove the end wall of a can by cutting through an outer portion of the rim, it has generally been proposed that the end wall be urged from the can during the cutting operation. Thus, with known openers the cutter has generally been arranged so as to remove the end wall by a shearing action. However, such arrangements result in considerable stresses both on the components of the opener and on the can itself with the result that reliable operation often may not be achieved, and in any event a considerable user-exerted force is required in order to operate the opener. It is therefore desirable that an opener of this type be effective only to provide a thin cut around the rim while not being adapted to shear the end wall from the can body, such that more reliable and easier operation may be achieved. However, this presents the problem of subsequent removal of the end wall and accordingly in a preferred embodiment the opener incorporates means separate from the cutting means arranged to assist or effect removal of the end wall from the can body during or after the cutting operation.

In one embodiment the removal means is in the form of a gripping mechanism including a hook-like member adapted to engage in a region of the cut extending around the rim such that subsequent pivotal movement of the opener relative to the can causes removal of the end wall. An advantage of this approach is that damage to the rim and to the can and end wall is minimised, and in some instances it may be possible to replace the end wall subsequent to removal.

Other forms of means to assist or effect removal of the end wall are however envisaged, and any suitable arrangement may be provided subject to one important requirement, namely that the means should be capable of operating successfully with can rims of different thickness.

One alternative approach to a gripping mechanism is the provision of means effective to distort the side wall of the can whereby to cause the end wall to become disengaged. A simple form of such means comprises a wedging member adapted for engagement, subsequent to the cutting operation, between, for example, the inside of the rim and the side wall of the can whereby pivotal movement of the member relative to the can is effective to distort the can sufficiently to disengage the end wall. Alternatively, the opener may additionally comprise a member, e.g. a roller, arranged to engage and distort the can side wall during the cutting operation. Such a member would be located behind the cutter and drive wheels in the direction of the cut, so that in operation the side wall is progressively distorted behind the cut as the cut is formed in the rim. In this way cutting of the rim and removal of the end wall is achieved in one overall operation.

Viewed from a third aspect the invention provides a can-opener including cutting means adapted to cut through the outer part of the rim joining an end wall of a can with the main body thereof, such opener incorporating means separate from the cutting means arranged to assist or effect removal of the end wall from the can body during or after the cutting operation.

Certain embodiments of the invention will now be described by way of example only and with reference to the accompanying drawings, wherein:

FIG. 7 is a front elevation of the opener in use;

FIG. 11 illustrates an alternative form of end wall removal means; and

Figure 12A:
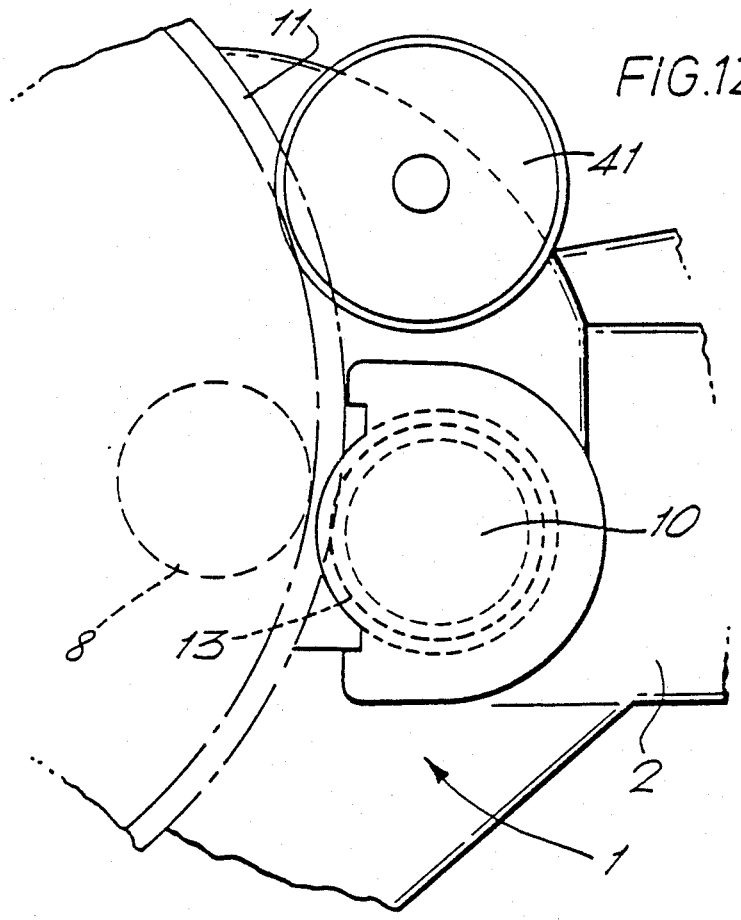
Figure 12B:
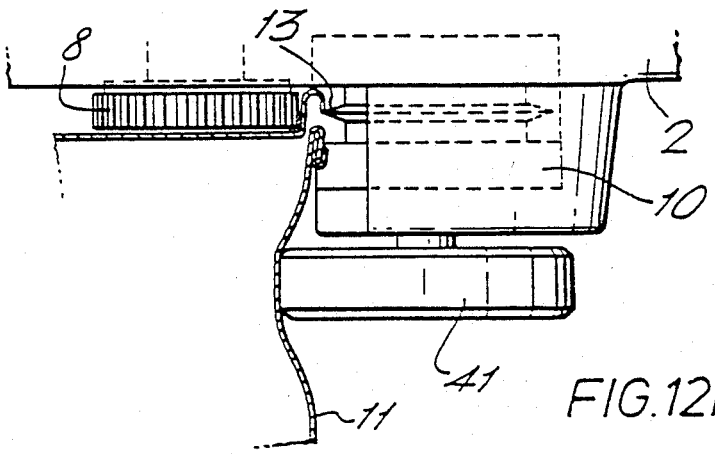

FIGS 12*a* and 12*b* illustrate schematically an alternative embodiment wherein the opener mounts a roller adapted to distort the side wall of the can during the cutting operation.

Figure 1:
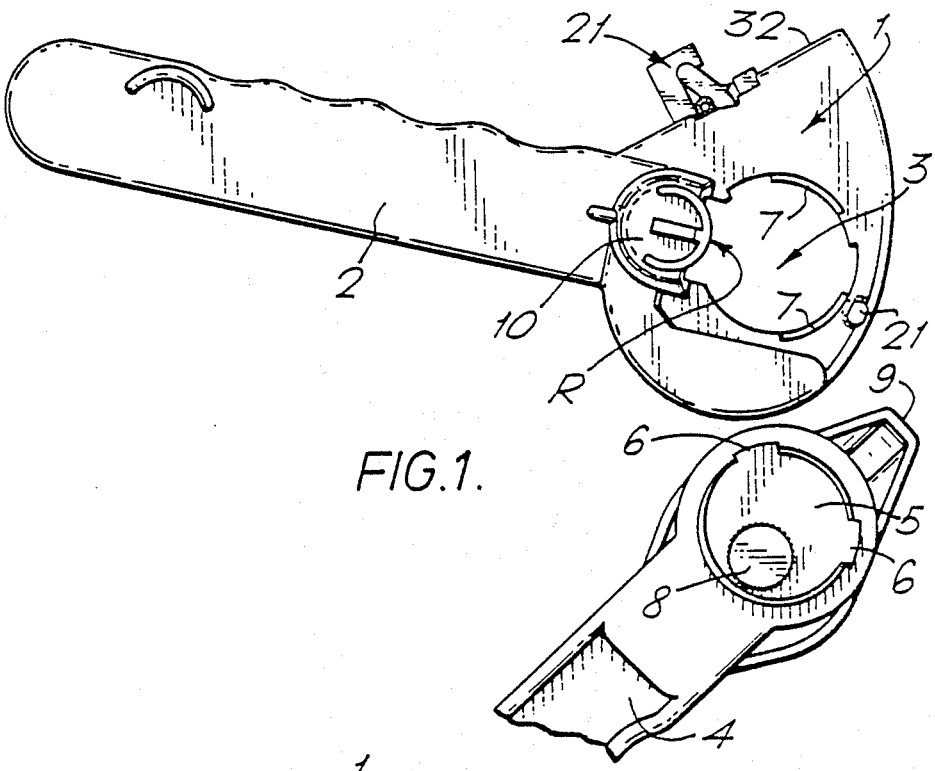
FIG. 1 is an exploded perspective view of the underside of a can-opener in accordance with the invention.

Referring firstly to FIG. 1, a can-opener comprises a molded plastics body portion 1 integrally formed with a first hand grip 2 and having a generally circular aperture 3. A second hand grip 4 of the opener is formed at one end thereof with a protruding disc 5 adapted for mating engagement with the aperture 3 so as to be rotatable therein upon scissor-like relative movement of the hand grips 2, 4. Lugs 6 projecting radially from the disc 5 co-operate with grooves 7 formed in the wall of the aperture 3 so as to interlock the two parts of the opener together. A toothed drive wheel 8 is eccentrically mounted to the disc 5 and may be rotated by means of a handle 9 as will be described in more detail below. The body portion 1 further comprises housing 10 having a partially cylindrical recess R in which is mounted a freely rotatable cutting wheel as will also be described in more detail below.

Figure 2:
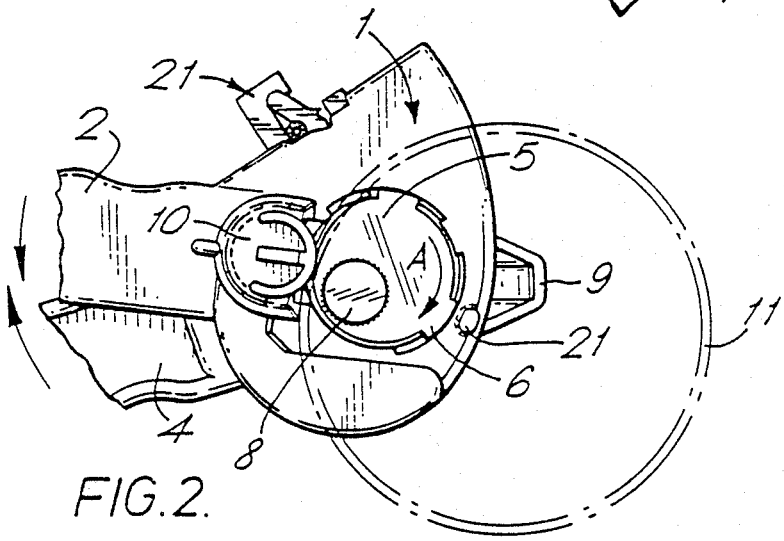
FIG. 2 is a perspective view of the underside of the opener shown in FIG. 1 illustrating the top of a can in phantom.

As shown in FIG. 2, in an "open" condition of the opener the eccentrically mounted drive wheel 8 is spaced sufficiently from the cutter wheel housing 10 to enable the rim of a can shown in broken lines 11 to be disposed therebetween. Thereafter, upon closing of the hand grips 2, 4 in a scissor-like fashion by the user, the disc 5 is rotated as shown by the arrow A such that the eccentrically mounted drive wheel 8 firmly engages the inner side of the rim 11.

Figures 4, 5:
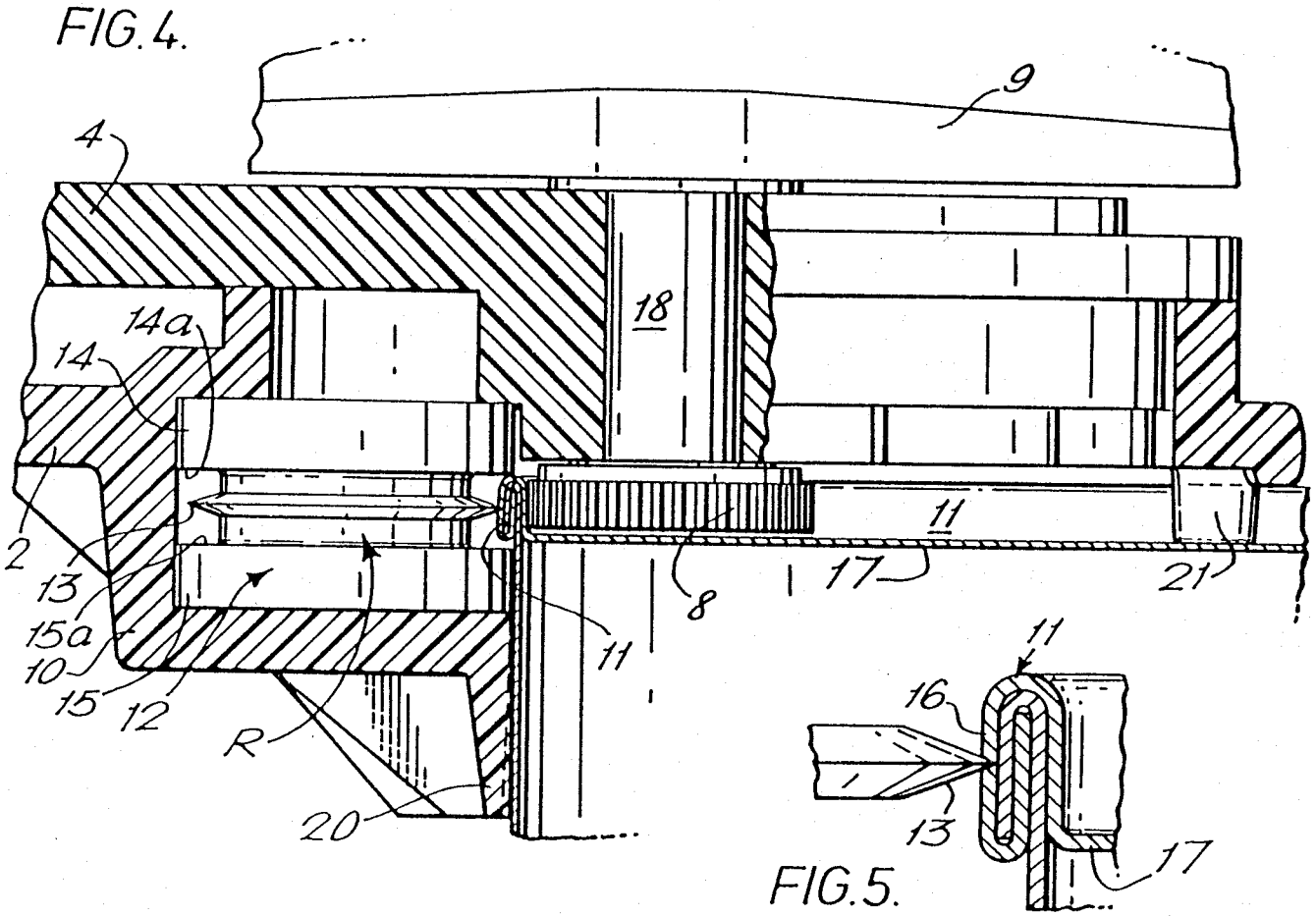
FIG. 4 is a sectional view on a enlarged scale of the opener in use.
FIG. 5 is an enlarged cross-section of a can rim during cutting.

As shown in FIG. 4, a generally cylindrical cutter wheel is rotatably mounted within the recess R of the housing 10. The cutter wheel 12 is integrally fabricated from a single piece of steel, and includes a sharp annular cutting edge 13 and upper and lower flanges 14, 15 defining upper and lower shoulder portions 14*a*, 15*a* which extend radially beyond the cutting edge 13. The cylindrical outer surfaces of the flanges 14, 15 bear directly on the partially cylindrical wall of the housing 10 defining said recess R.

Figure 3:
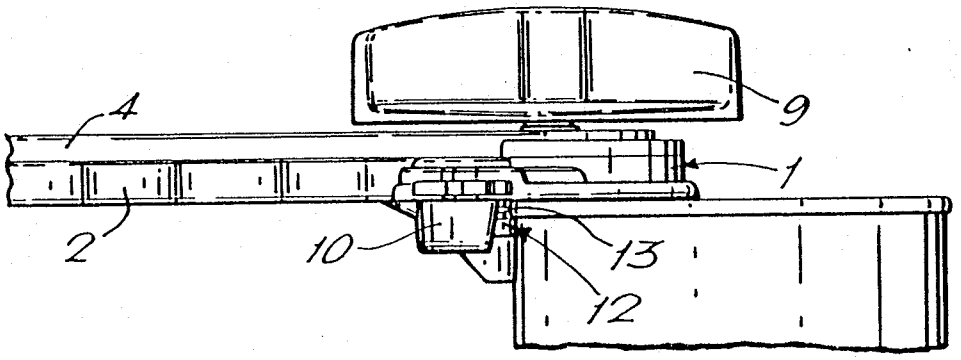
FIG. 3 is a side elevation of the opener in use.

As shown in FIGS. 3 and 4, in the closed condition of the opener the rim 11 of the can is tightly gripped between the cutter wheel 12 and the drive wheel 8 such that the cutting edge 13 penetrates at least the outer wall 16 of the rim 11, which as shown in FIG. 5 is generally integral with the end wall or lid 17 of the can to be opened.

In this condition, the handle 9 which is coupled to the drive wheel 8 by means of a shaft 18 may be rotated by the user while squeezing the hand grips 2, 4 together such that the annular cutting edge 13 of the cutting wheel 12 extends through and around the outer wall 16 of the rim 11. Thus, the wall portion 16 is separated from the main body of the can and the other wall portions making up the rim 11.

In the illustrated can-opener various means are provided to ensure that the annular cutting edge 13 of the cutting wheel 12 is accurately guided around the rim such that reliable and consistent operation is achieved. As shown in FIGS. 3 and 4, the housing 10 includes a portion 20 extending downwardly therefrom which defines a guide surface against which the side wall of the can abuts in use. This helps to ensure that the can and the opener remain in correct relative alignment during cutting. The lower flange 15 of the cutting wheel 12 also abuts the side wall of the can for the same purpose, and in addition extends beneath the rim so as to ensure that the rim remains engaged between the cutter and the drive wheel.

During cutting, as shown in FIG. 4, the upper flange 14 of the cutting wheel bears down on the top surface of the rim 11. This ensures that the cut remains at a constant height relative to the rim such that reliable operation is achieved and that the cut always meets up with itself once it returns to its starting point. As shown in FIG. 7, a thickened portion 30 of the body portion which bears down on the can rim during cutting is effective to tilt the opener through a small angle $\alpha$ in the order of $\frac{1}{2}°$ to 3° whereby the angle of attack of the cutting edge 13 is directed downwardly slightly from the horizontal. This ensures that during cutting the upper flange 14 of the cutting wheel remains as shown in FIG. 4 bearing down on the top of the rim.

Furthermore, as shown in FIG. 4, a projection 21 is provided on the underside of the body portion 1 which engages in use the can lid 17. The projection 21 cooperates with portion 20 to assist in maintaining the attitude of the opener in the radial direction.

Figure 6:
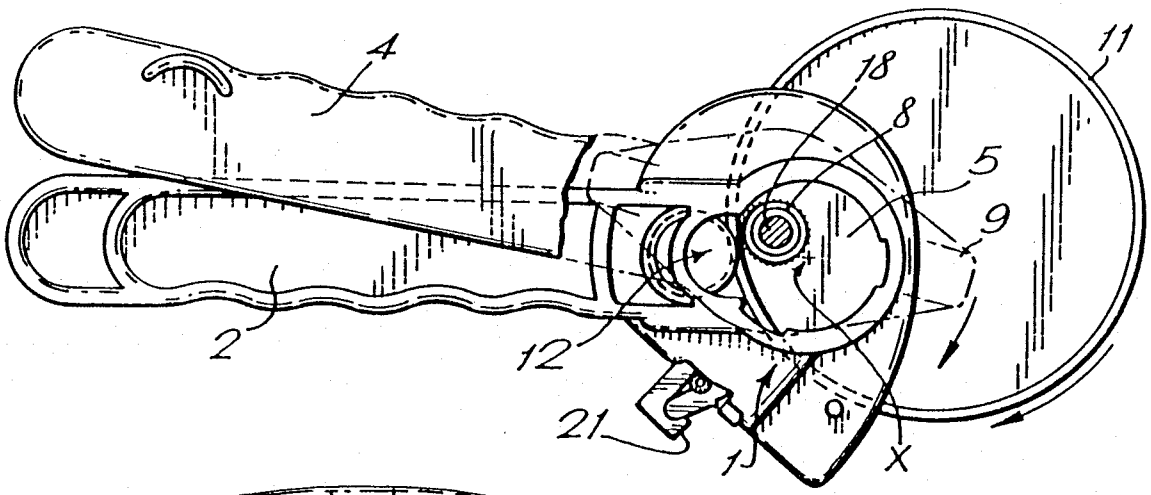
FIG. 6 is a plan view of the opener in use.

Referring now to FIG. 6, it will be seen that in the closed condition of the opener where the rim 11 of a can is tightly gripped between the drive and cutting wheels 8, 12, the hand grips 2, 4 remain in a slightly spaced apart condition and, moreover, the axes of rotation of the cutter wheel 12, the drive wheel 8 and the rotatable disc 5 respectively are out of alignment. The effect of this is that when the handle 9 is rotated in clockwise direction as shown, there is a tendency for the disc 5 to be urged in an anti-clockwise direction thus tightening the engagement between the driving wheel 8 and the cutter wheel 12. This assists the user in maintaining adequate pressure to cut through the outer wall of the rim throughout the cutting operation. In addition, the arrangement automatically compensates for wear to either the drive wheel 8 or the cutter wheel 12.

Figure 8:
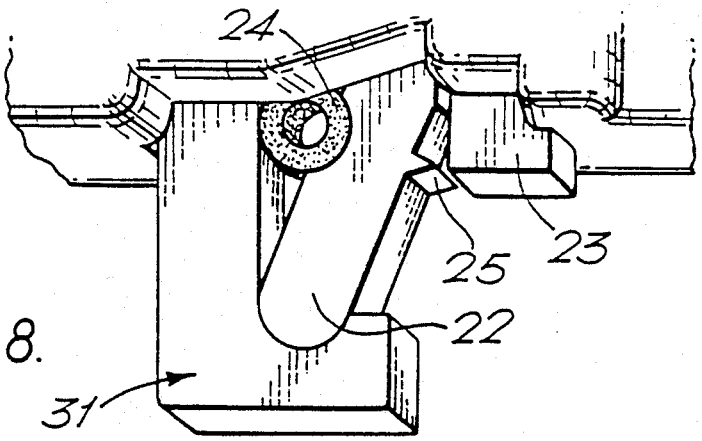
FIGS. 8 to 10 illustrate the construction and operation of one form of end wall removal means.
Figure 9:
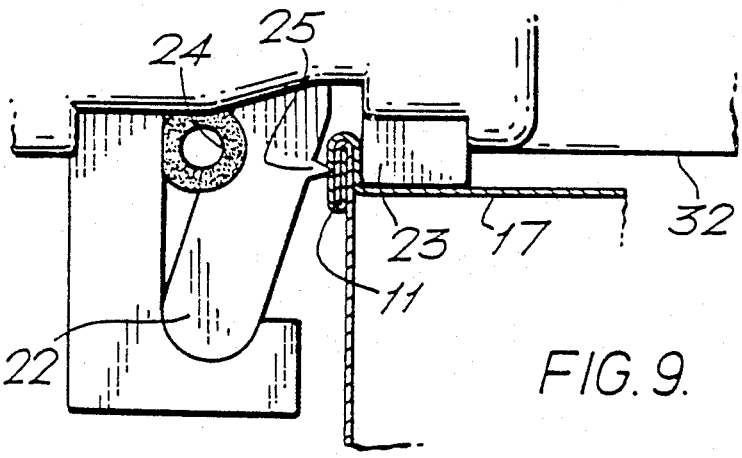
Figure 10:
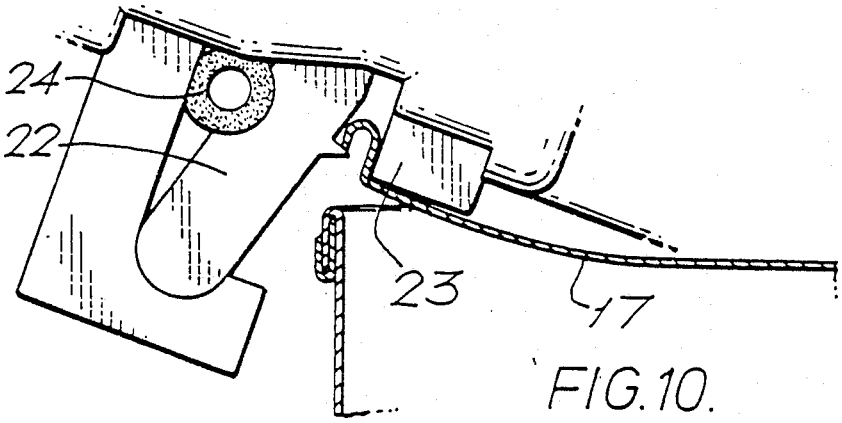

As shown in the drawings, the illustrated opener is effective during cutting to form a cut around the outer part of the rim and thus separate the end wall from the main body of the can, but is not effective to shear and thus necessarily remove the end wall during the cutting operation. Therefore, the opener additionally incorporates an end wall removing means 31 one embodiment of which is illustrated in detail in FIGS. 8 to 10. The mechanism comprises a pivotable member 22 and an abutment member 23, the member 22 being displaceable away from the member 23 against the restoring force provided by a resilient seating 24. The pivotable member 22 further comprises a claw 25. Thus, as shown in FIGS. 9 and 10, following cutting, the rim 11 of the can is inserted and gripped between the pivotable and abutment members 22, 23, such that the claw 25 engages in the cut formed in the outer wall of the rim. The opener is then pivoted relative to the can such that the end wall 17 is levered off as shown in FIG. 10. The edge 32 of the body portion engages the lid 17 during removal some distance radially inwardly from the rim. Such engagement minimises bending of the lid, which is important if replacement of the lid is desired. Other gripping mechanisms are envisaged which operate in a similar manner to that shown in FIGS. 8 to 10; for example the pivotable member 22 could be replaced by a slidable member which is spring loaded into engagement with the rim.

FIG. 11 illustrates an alternative form of end wall removal means which may likewise be mounted to an opener in accordance with the invention. Such means includes a wedging element 40 arranged to engage the inside of the rim and the can side wall as illustrated so that relative pivotal movement of the can and opener distorts the side wall sufficiently to spring apart a portion of the cut rim and thus separate the end wall.

An alternative embodiment of end wall removal means is shown diagrammatically in FIGS. 12*a* and 12*b*. In this embodiment the opener mounts an additional roller 41 arranged to engage and distort the side wall of the can progressively as rim is cut. The roller 41 is located behind the cutter wheel in the direction of the cut and is thus effective to remove the end wall during the cutting operation. This removes the need for the user to carry out a separate end wall removal operation.

I claim:

1. A can opener for opening a can having an end wall joined to a main body by a rim that includes inner and outer parts, whereby the end wall is separated from the main body by cutting through the outer part of the rim, which opener comprises:

(a) a body portion formed of plastic material;

(b) a cutter wheel for engaging the outer part of the rim;

(c) the body portion including a recess configured to locate and support the cutter wheel for free rotation therein;

(d) a rotatable drive wheel for engaging the inner part of the rim in gripping relation with the cutter wheel when the cutter wheel is in engagement with the outer part of the rim; and (e) means for removing the separated end wall from the can body, which removal means including a gripping mechanism provided with a hook-like member for engaging a region of the cut rim in order to permit removal of the end wall when the opener is pivoted relative to the can.

2. A can opener for opening a can having an end wall joined to a main body by a rim that includes inner and outer parts, whereby the end wall is separated from the main body by cutting through the outer part of the rim, which opener comprises:

(a) a body portion formed of plastic material;

(b) the body portion including a recess defined in part by a partially cylindrical peripheral wall, by a flat lower wall and by a flat upper wall spaced from and extending parallel to the lower wall;

(c) a cutter wheel for engaging the outer part of the rim, the cutter wheel including an annular cutting edge disposed between a pair of axially spaced flanges, the flanges having cylindrical outer bearing surfaces, and the cutter wheel having flat upper and lower surfaces;

(d) said cutter wheel being located partly within said recess so that said cylindrical outer bearing surfaces of said flanges directly engage said partially cylindrical peripheral wall, said flat upper surface of the cutter wheel directly engages an upper wall of the recess, and said flat lower surface of the cutter wheel directly engages the lower wall of said recess, whereby said recess constitutes the sole means for locating and supporting said cutter wheel disposed for free rotation therein; and (e) a rotatable drive wheel for engaging the inner part of the rim in gripping relation with the cutter wheel when the cutter wheel is disposed in engagement with the outer part of the rim, said direct engagement between the recess peripheral wall and said bearing surfaces of said upper and lower flanges withstanding the force on the cutter wheel imparted thereto upon tight gripping engagement of the cutter wheel with a can rim.

3. A can opener for opening a can having an end wall joined to a main body by a rim that includes inner and outer parts, whereby the end wall is separated from the main body by cutting through the outer part of the rim, which opener comprises:

(a) a body portion formed of plastic material;

(b) the body portion including a recess defined in part by a partially cylindrical peripheral wall;

(c) a cutter wheel for engaging the outer part of the rim, the cutter wheel including an annular cutting edge disposed between a pair of axially spaced upper and lower flanges, each flange including a cylindrical outer surface;

(d) the recess being configured to locate and support the cutter wheel for free rotation therein and permit the cylindrical outer surfaces of the flanges to bear directly on the cylindrical peripheral wall;

(e) a rotatable drive wheel for engaging the inner part of the rim in gripping relation with the cutter wheel when the cutter wheel is disposed in engagement with the outer part of the rim; and (f) a rotatable disk carried by the body portion, the drive wheel being eccentrically mounted to the disk, the drive wheel axis of rotation being substantially parallel to the longitudinal axis of the can when the opener is disposed in a position of use, and the rim of the can being tightly gripped between the cutter wheel and the drive wheel when the disk is rotated relative to the body portion.

4. A can opener comprising a cutting means for cutting through the outer part of a rim joining an end wall of a can with a main body thereof, the cutting means including a cutting edge which is effective to provide a thin cut around the rim without fully disengaging the end wall from the main body during the cutting operation, the opener further comprising removal means separate from the cutting means for removing the end wall from the can body after the cutting operation, which removal means includes a gripping mechanism provided with an engagement member configured for engaging an edge of the cut formed in the rim in order to facilitate removal of the end wall when the opener is pivoted relative to the can.

5. The can opener of claim 3, wherein the axes of rotation of the rotatable disk, the drive wheel and the cutter wheel are nonaligned during operation of the opener for imparting a torque on the disk when the drive wheel rotates against the resistance of the cutter wheel, thereby maintaining pressure exerted on the rim.

6. The can opener of claim 3 wherein the cutter wheel further includes a first shoulder portion engageable with the top of the rim for locating the position of the cutting edge relative to the rim when the opener is disposed in a position of use.

7. The can opener of claim 6 wherein the upper flange defines the first shoulder portion.

8. The can opener of claim 7 wherein the lower flange defines a second shoulder portion for engaging the body portion of the can under the bottom of the rim when the opener is disposed in a position of use.

9. The can opener of claim 6 wherein the cutter wheel axis of rotation is offset from the longitudinal axis of the can when the opener is disposed in a position of use, thereby disposing the angle of attack of the cutting edge into the rim in such a position so as to cause the first shoulder portion to constantly engage against the top of the rim.

10. The can opener of claim 9 further including means carried by the body portion and egageable against the end wall of the can for disposing the cutter wheel at a desired inclination relative to the can.

11. The can opener of claim 3 further including means for removing the separated end wall from the main body of the can.

12. The can opener of claim 4 wherein the engagement member has a hook-like configuration.

13. The can opener of claim 11 wherein the removal means is adapted to distort the main body of the can so as to cause the end wall to become disengaged therefrom.

14. The can opener of claim 13 wherein the removal means includes a wedging member for engagement with the can after the cutting operation has been completed.

15. The can opener of claim 13 wherein the removal means comprises a member disposed for engaging and distorting the main body of the can during the cutting operation.

* * * * *